US009120148B2

(12) United States Patent
Richaud

(10) Patent No.: US 9,120,148 B2
(45) Date of Patent: Sep. 1, 2015

(54) SUBMERGED ENTRY NOZZLE

(75) Inventor: Johan L. Richaud, Cheval Blanc (FR)

(73) Assignee: VESUVIUS CRUCIBLE COMPANY, Wilmington, DE (US)

( * ) Notice: Subject to any disclaimer, the term of this patent is extended or adjusted under 35 U.S.C. 154(b) by 0 days.

(21) Appl. No.: 13/806,914

(22) PCT Filed: May 11, 2011

(86) PCT No.: PCT/US2011/036068

§ 371 (c)(1),
(2), (4) Date: Dec. 26, 2012

(87) PCT Pub. No.: WO2012/003047

PCT Pub. Date: Jan. 5, 2012

(65) Prior Publication Data

US 2013/0098952 A1 Apr. 25, 2013

Related U.S. Application Data

(60) Provisional application No. 61/361,265, filed on Jul. 2, 2010.

(51) Int. Cl.
*B22D 41/50* (2006.01)

(52) U.S. Cl.
CPC ..... *B22D 41/50* (2013.01)

(58) Field of Classification Search
CPC ..... B22D 41/50; B22D 41/56; B22D 41/54; B22D 41/58
USPC ..... 266/236; 164/133, 488, 337, 437, 335; 222/591, 594, 606, 607
See application file for complete search history.

(56) References Cited

U.S. PATENT DOCUMENTS

| | | | | |
|---|---|---|---|---|
| 4,949,778 | A | 8/1990 | Saito et al. | |
| 6,016,941 | A | 1/2000 | Damle | |
| 8,037,924 | B2 * | 10/2011 | Kido et al. | 164/437 |
| 2005/0127582 | A1 | 6/2005 | Richaud | |
| 2006/0169728 | A1 * | 8/2006 | Xu et al. | 222/606 |
| 2007/0158884 | A1 * | 7/2007 | Tsukaguchi | 266/236 |
| 2009/0288799 | A1 | 11/2009 | Miyazaki et al. | |

FOREIGN PATENT DOCUMENTS

| | | | | |
|---|---|---|---|---|
| AU | 4778472 | A | 4/1974 | |
| CN | 201385125 | Y | 1/2010 | |
| CN | 101733375 | A | 6/2010 | |
| GB | 244805 | * | 6/2008 | B22D 41/50 |
| GB | 2444805 | A | 6/2008 | |
| JP | 4846534 | A | 7/1973 | |
| JP | 55149753 | * | 10/1980 | B22D 11/10 |
| JP | 55149753 | A | 11/1980 | |
| JP | 56148453 | A | 11/1981 | |
| JP | 58112641 | A | 7/1983 | |
| JP | 08294757 | A | 11/1996 | |
| RU | 2204461 | C1 | 5/2003 | |
| RU | 2379154 | C2 | 1/2010 | |

* cited by examiner

*Primary Examiner* — Scott Kastler
*Assistant Examiner* — Michael Aboagye
(74) *Attorney, Agent, or Firm* — Thomas Clinton; Donald M. Satina

(57) ABSTRACT

A pour tube for casting molten metal is adapted to reduce turbulence and mold disturbances, thereby producing a more stable, uniform outflow. The pour tube includes a bore having a body in communication with an enlarged outlet portion. Exit ports in communication with the outlet portion have an offset design in which at least one wall of the exit port is tangent to a circle having a larger radius than the body of the bore.

17 Claims, 9 Drawing Sheets

SUBMERGED ENTRY NOZZLE

FIELD OF THE INVENTION

This invention relates generally to a refractory article and, more particularly, to a refractory pour tube for use in the transfer of molten metal in a continuous casting operation.

BACKGROUND

In the continuous casting of metal, particularly steel, a stream of molten metal is typically transferred via a refractory pour tube from a first metallurgical vessel into a second metallurgical vessel or mold. Such tubes are commonly referred to as nozzles or shrouds and possess a bore adapted to transfer molten metal. Pour tubes include submerged-entry nozzles (SEN) or submerged-entry shrouds (SES), which discharge molten metal below the liquid surface of a receiving vessel or mold.

Liquid metal is discharged from the downstream end of the bore through one or more outlet ports. One important function of a pour tube is to discharge the molten metal in a smooth and steady manner without interruption or disruption. A smooth, steady discharge facilitates processing and can improve the quality of the finished product. A second important function of a pour tube is to establish proper dynamic conditions within the liquid metal in the receiving vessel or mold in order to facilitate further processing. Producing proper dynamic conditions may require the pour tube to possess a plurality of exit ports that are arranged so as to cause the stream of molten metal to be turned in one or more directions upon discharge from the tube.

It may be desirable, for a number of reasons, to induce rotational flow within the mold into which the molten metal is being discharged. Rotation of the flow increases the residence time inside the mold liquid pool to enhance the flotation of inclusions. Rotation of the flow also produces temperature homogenization, and reduces the growth of dendrites along the steel solidifying front. Rotation of the flow also reduces the mixing of steel grades when consecutive grades of steel flow through the pour tube without interruption.

Various technologies have been used in attempts to provide rotation of the flow. Electromagnetic stirring devices may be placed below the entry nozzle. Entry nozzles have been designed that can be rotated in use. Entry nozzles have also been designed with curved exit ports tangent to the bore of the tube.

Various disadvantages are seen in the prior art technology. Electromagnetic stirring devices have a limited life in a hostile environment, rotation of entry nozzle permits oxygen to come in contact with molten metal stream, and curved exit ports are not successful in inducing rotational flow in all mold configurations.

A need persists for a refractory pour tube that produces rotational flow in a variety of mold configurations without the use of additional electromechanical devices. Ideally, such a tube would also improve the flow of molten metal into a casting mold and improve the properties of the cast metal.

SUMMARY OF THE INVENTION

The present invention relates to a pour tube for use in the casting of molten metal. The pour tube includes at least two exit ports and, relative to prior art, provides a more effective rotational flow inside the molds into which molten material flows from the pour tube. Rotation of the flow increases the residence time inside the liquid mold pool to produce better flotation of inclusions, reduces the growth of dendrites formed along the steel solidifying front, and allows a significant reduction of steel grade mixing when consecutive grades of steel are passing through the pour tube without interruption. Particular configurations of rotational flow can also reduce competing surface flows that induce high turbulence levels. The production of a rotating flow by the present invention provides a replacement for the use of electromagnetic stirring of the contents of the mold to provide thermal homogeneity and optimal mold powder melting. These benefits can result in an improved finished product.

In a broad aspect, the article comprises a pour tube having an enlarged port distributor in direct fluid communication with exit ports. The exit ports are disposed around the port distributor at specific angles, configurations and in specific relative dimensions to produce rotational flow.

In one aspect, the invention includes exit ports that comprise an inner wall in communication with the port distributor and the outer surface of the pour tube, and an outer wall in communication with the port distributor and the outer surface of the pour tube. The outer wall and the inner wall may be entirely vertical, may contain vertical portions, or may be configured at a smaller angle to the vertical than other surfaces of the exit ports. The outer wall has a greater length in the horizontal plane than does the inner wall. The outer walls of the exit ports, or horizontal projections of the outer walls of the exit ports, do not intersect the bore, or do not intersect a vertical projection of the bore. In certain embodiments, the outer walls of the exit ports are tangent to a circle that is concentric with the bore and has a greater radius than the bore, or are tangent to the port distributor.

In an embodiment of the invention, the exit ports are spaced regularly at a rotation angle theta around the periphery of the port distributor, and the exit ports have a port width equal to $2r_{pd}\sin(\text{theta}/2)^2$, wherein $r_{pd}$ is the port distributor radius and theta is the rotation angle around the periphery of the port distributor occupied by the port, expressed in radians.

In another embodiment of the invention, the exit ports are configured so that $4\pi r_b > n r_{pd}(\text{theta}) > 1.3\pi r_b$, wherein $r_b$ is the bore radius, n is the number of exit ports, $r_{pd}$ is the port distributor radius, and theta is the rotation angle around the periphery of the port distributor occupied by the port, expressed in radians.

In another embodiment of the invention, the exit ports have a nonzero flare angle in the horizontal plane that is equal to or less than theta/2.

In another embodiment of the invention, the exit ports are configured so that $3\pi r_b^2 > hna > 0.5\pi r_b^2$, wherein $r_b$ is the bore radius, h is the exit port height, n is the number of exit ports, and a is the width of the port entrance. In terms of absolute values, an embodiment of the invention makes use of exit ports having an exit port height equal to or greater than 8 mm to facilitate manufacturing of the pour tube of the invention, and to expedite liquid metal castability.

In a further embodiment of the invention, the exit ports are configured so that the maximum angle theta around the periphery of the port distributor occupied by an exit port is $\arccos(r_{pd}/r_{ex})$, and so that $a < r_{pd}((r_{ex}-r_{pd})/r_{ex})$, where a is the width of the port entrance, $r_{pd}$ is the port distributor radius and $r_{ex}$ is the pour tube radius in the horizontal plane of the port distributor. In terms of absolute values, an embodiment of the invention makes use of exit ports having an exit port width equal to or greater than 8 mm to facilitate manufacturing of the pour tube of the invention, and to expedite liquid metal castability.

Design elements of the present invention, including the number of exit ports, port distributor size and configuration, port wall height, port wall width, port wall flare angle, and the absence of a straight line from the vertical axis of the port distributor through the port to the exterior of the pour tube, lead to swirling of the fluid around an exit port axis as it flows outward through the exit port. The jet momentum of fluid passing through the exit ports of a pour tube of the present invention is reduced, as is the strength of the jets coming in contact with a mold wall. Prior an pour tubes exhibit an increase in fluid velocity between the inlet and the exit port; in the present invention, this increase is minimized or, in some cases, reduced. Pour tubes of the present invention produce curved fluid paths both within and outside the exit port. Pour tubes of the present invention with four ports and six ports produce a swirling velocity that is uniform and evenly distributed. The swirling may take the form of a spiral of helical flow with the port axis as its axis. The reduction of jet momentum enables the pour tube of the present invention to be configured and used without a skirt or shield disposed external to, and in the horizontal plane of, the ports.

Other details, objects and advantages of the invention will become apparent through the following description of a present preferred method of practicing the invention.

DETAILED DESCRIPTION OF INVENTION

The invention comprises a pour tube for use in the continuous casting of molten metal. The pour tube comprises a bore fluidly connected to at least two exit ports. Pour tube means shrouds, nozzles, and other refractory pieces for directing a stream of molten metal, including, for example, submerged entry shrouds and nozzles. The invention is particularly suited for pour tubes having an exit port adapted to deliver molten metal below the surface of the metal in a receiving vessel such as a mold.

Figure 1:
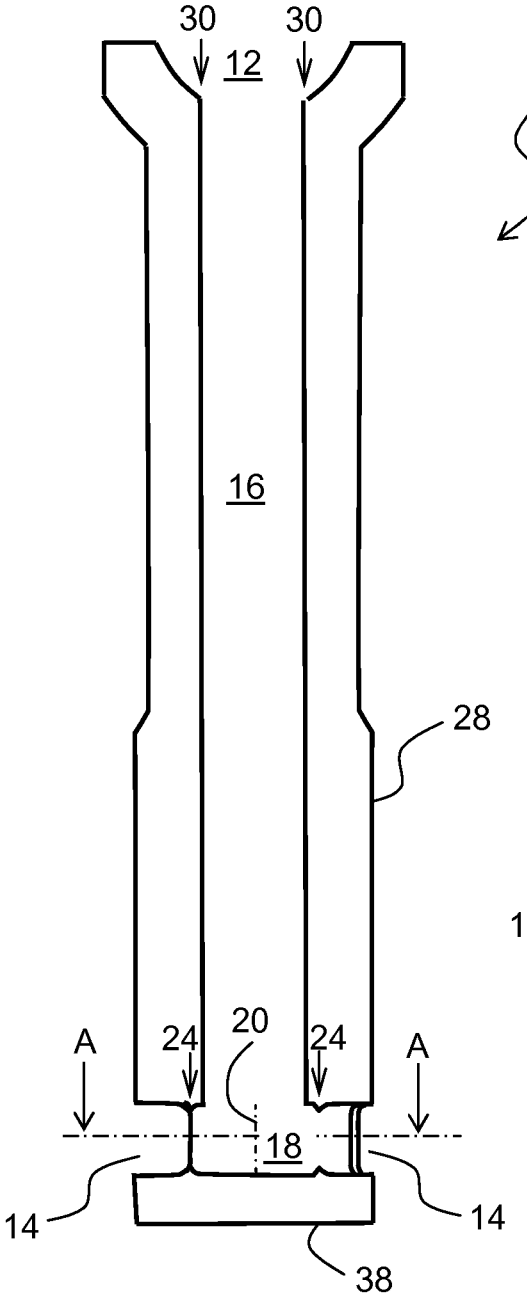
FIG. 1 shows a sectional view, along a vertical section, of an embodiment of a pour tube of the current invention.

FIG. 1 shows a view, along a vertical section, of a pour tube 10. The pour tube 10 comprises an inlet 12 and an exit port 14 fluidly connected by a bore 16 and a port distributor 18. The pour tube 10 permits a stream of molten metal to pass from an upstream end at the inlet 12, through the bore and to a downstream end at the port distributor 18, the port distributor 18 having a vertical axis 20 and a radial extent 24, and thence to exit port 14. The exit port 14 is defined by the perimeter of a hole that extends through the pour tube 10 to pour tube outer surface 28 from port distributor radial extent 24 of port distributor 18. The perimeter of the exit port may be of any convenient general shape including, but not limited to, oval, polygonal or any combination thereof. Conveniently, the general shape of the exit port is substantially rectangular, and may be rectangular with corners having a radius of curvature. In the case of an exit port with a substantially rectangular shape, the exit port may have exit port walls, an exit port upper surface proximal to the upstream end of the pour tube, and an exit port lower surface proximal to the downstream end of the pour tube. The exit port walls connect the exit port upper surface to the exit port lower surface. Individual embodiments of the invention may have exit port walls that may be described by straight lines not parallel to the longitudinal or vertical axis 20. Bore 16 has, in this embodiment, a bore radial extent 30 that is less than port distributor radial extent 24. In certain embodiments of the invention, a port collector basin extends downwardly from, and is in fluid communication with, port distributor 18. In an alternate embodiment of the invention, a bottom hole connects the port distributor 18 to a pour tube bottom surface 38.

Figure 2:
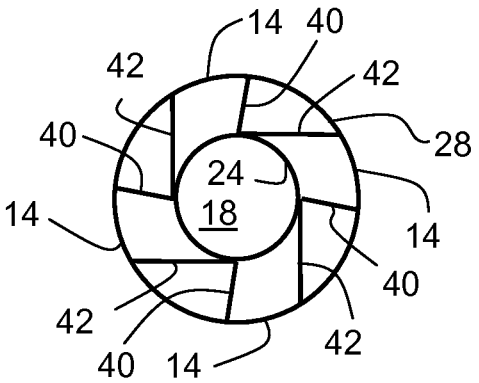
FIG. 2 shows a sectional view, along a horizontal section, of an embodiment of a pour tube of the present invention.

FIG. 2 shows a sectional view, along section line A-A of FIG. 1, of the embodiment of a pour tube of the present invention shown in FIG. 1. Four exit ports 14 fluidly connect port distributor 18 to the outer surface 28 of pour tube 10. Each exit port 14 in this embodiment has an inner exit port wall 40 and an outer exit port wall 42 partially defining the exit port. Outer exit port wall 42 has a greater length in a horizontal plane orthogonal to vertical axis 20 than does inner exit port wall 40. The radial extent of the port distributor 24 is greater than the radial extent 30 of the bore. At least one outer exit port wall 42 is tangent to a circle that has a radial extent greater than the radial extent of the inner bore wall. In the embodiment shown, each exit port wall 42 is tangent to a circle that has a greater radius than the radius of inner bore wall and, in this embodiment, each exit port wall 42 is tangent to the circle defined by the radial extent 24 of port distributor 18. Each exit port 14 in this embodiment has a flare; the cross-sectional area of each port at the extent 24 of the port distributor is smaller than the cross sectional area of the port at the outer surface 28 of the pour tube.

Figure 3:
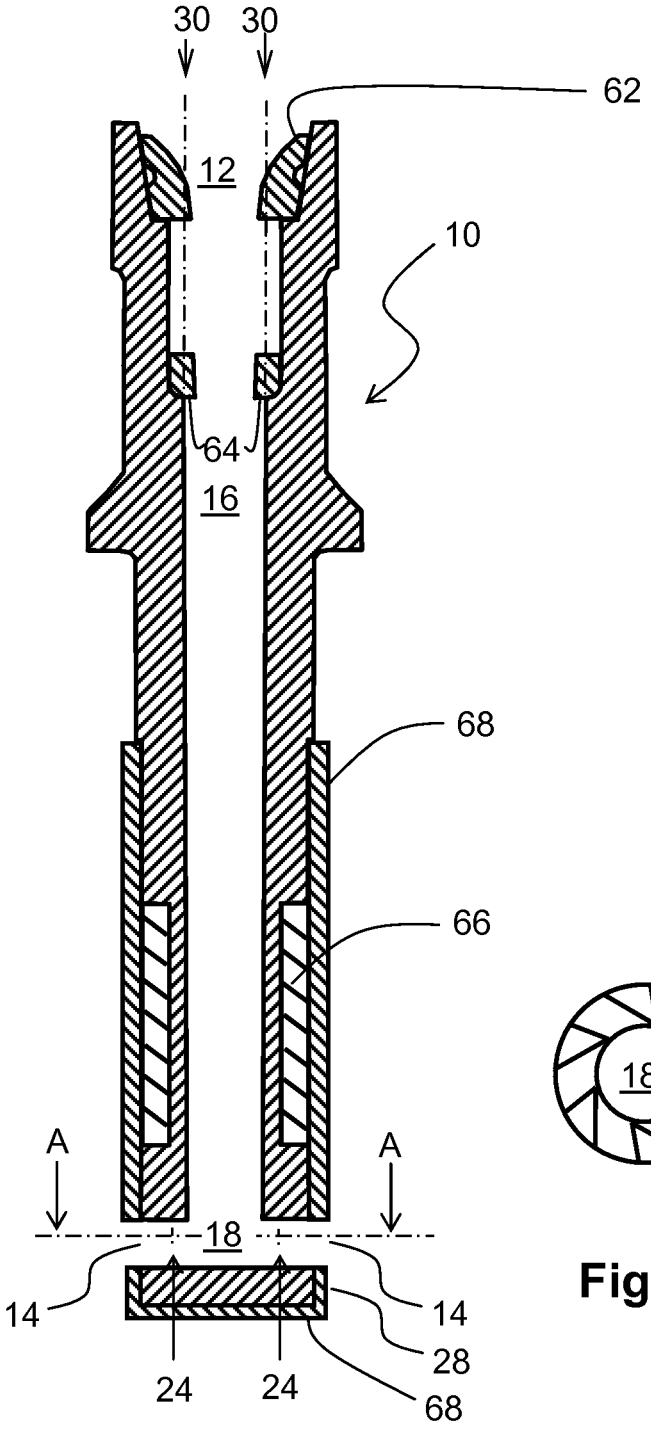
FIG. 3 shows a sectional view, along a vertical section, of an embodiment of a pour tube of the current invention.

FIG. 3 shows a view, along a vertical section, of a pour tube 10. The pour tube 10 comprises an inlet 12 and an exit port 14 fluidly connected by a bore 16 and a port distributor 18. The pour tube 10 permits a stream of molten metal to pass from an upstream end at the inlet 12, through the bore and to a downstream end at the port distributor 18, the port distributor 18 having a radial extent 24, and thence to exit port 14. The exit port 14 is defined by the perimeter of a hole that extends through the pour tube 10 to pour tube outer surface 28 from port distributor radial extent 24 of port distributor 18. The perimeter of the exit port may be of any convenient general shape including, but not limited to, oval, polygonal or any combination thereof. Conveniently, the general shape of the exit port is substantially rectangular, and may be rectangular with corners having a radius of curvature. In the case of an exit port with a substantially rectangular shape, the exit port may have exit port walls, an exit port upper surface proximal to the upstream end of the pour tube, and an exit port lower surface proximal to the downstream end of the pour tube. The exit port walls connect the exit port upper surface to the exit port lower surface. Seat insert 62, located within the bore at inlet 12, permits the bore tube to be fitted to a vessel above the pour tube. Seat insert 62 may be formed, for example, from a refractory material such as zirconia. Lower seat insert 64, located within the bore below seat insert 62, also performs seating functions. Lower seat insert 64 may be formed, for example, from a refractory material such as zirconia. Slag line sleeve 66, located circumferentially around the exterior of pour tube 10, enables the pour tube to withstand mechanical and thermal stresses produced at the slag line. Slag line sleeve 66 may be formed, for example, from a refractory material such as zirconia. Insulating fiber 68, located on the exterior of a lower portion of the pour tube, protects exterior of the pour tube. Insulating fiber 68 may be formed from fibers of a refractory material.

Figure 4:
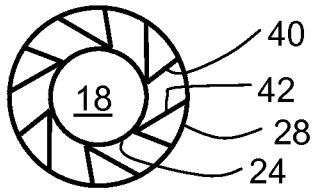
FIG. 4 shows a sectional view, along a horizontal section, of an embodiment of a pour tube of the present invention.

FIG. 4 shows a sectional view, along section line A-A of FIG. 3, of the embodiment of a pour tube of the present invention shown in FIG. 3. Six exit ports 14 fluidly connect port distributor 18 to the outer surface 28 of pour tube 10. Each exit port 14 in this embodiment has an inner exit port wall 40 and an outer exit port wall 42 partially defining the exit port. Outer exit port 42 has a greater length in the horizontal plane than does inner exit port 40. The radial extent 24 of the port distributor 18 is greater than the radial extent 30 of the bore. At least one outer exit port wall 42 is tangent to a circle that has a greater radius than the radius of inner bore wall 30. In the embodiment shown, each exit port wall 42 is tangent to a circle that has a greater radius than the radius of inner bore wall 30 and, in this embodiment, each exit port wall 42 is tangent to the circle defined by the radial extent 24 of port distributor 18. Each exit port 14 in this embodiment has a flare; the cross-sectional area of each port at the extent 24 of the port distributor is smaller than the cross sectional area of the port at the outer surface 28 of the pour tube.

Figure 5:
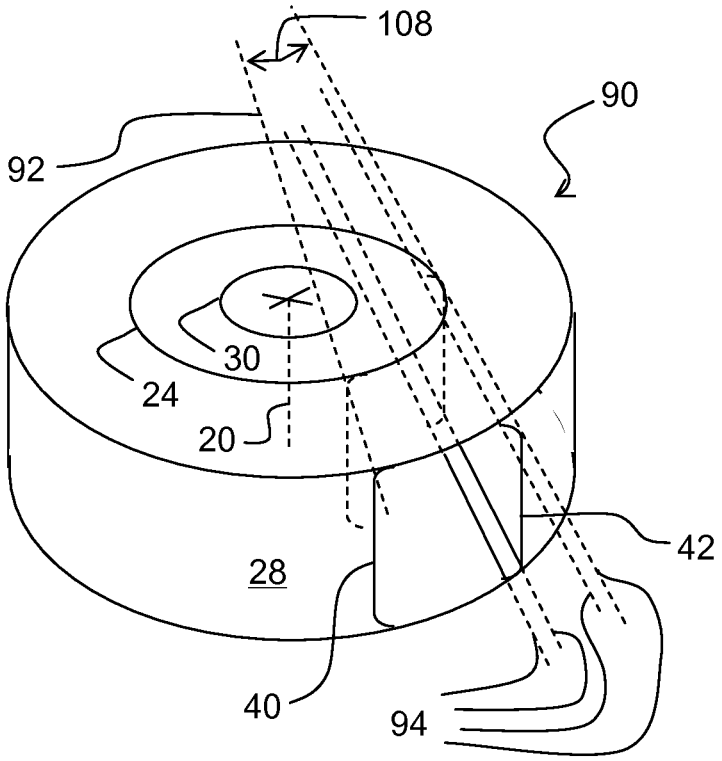
FIG. 5 shows a perspective diagram of a portion of an embodiment of a pour tube of the present invention.

FIG. 5 shows a perspective diagram of a portion 90 of an embodiment of a pour tube of the present invention. The diagram depicts the port distributor and the horizontally adjacent portions of the pour tube. The lower end of the bore meets the upper end of the port distributor; the surface shown between radial extent 24 of the port distributor and radial extent 30 of the bore wall represents the upper surface of the port distributor. The portion of the pour tube between the extent 24 of the port distributor and the outer surface 16 houses the exit ports. A single exit port is shown, with inner port wall 40 and outer port wall 42. A single projection line 92 is shown for inner exit port wall 40; this projection line is tangent to a circle coaxial to the port distributor that has a radial extent that is less than the radial extent 30 of the bore. Horizontal projection lines 94 are shown for outer port wall 42. The plane of outer port wall 42 is tangent to a circle coaxial to the port distributor that has a greater radius than the radius of inner bore wall 30. In the embodiment shown, the plane of outer port wall 42 is tangent to a circle that has the same radius as the radial extent 24 of the port distributor. Port flare angle 108 is the angle between the inner port wall 40 and outer port wall 42. Projections of the inner port walls 40 do not intersect the axis 20 of the port distributor.

Figure 6:
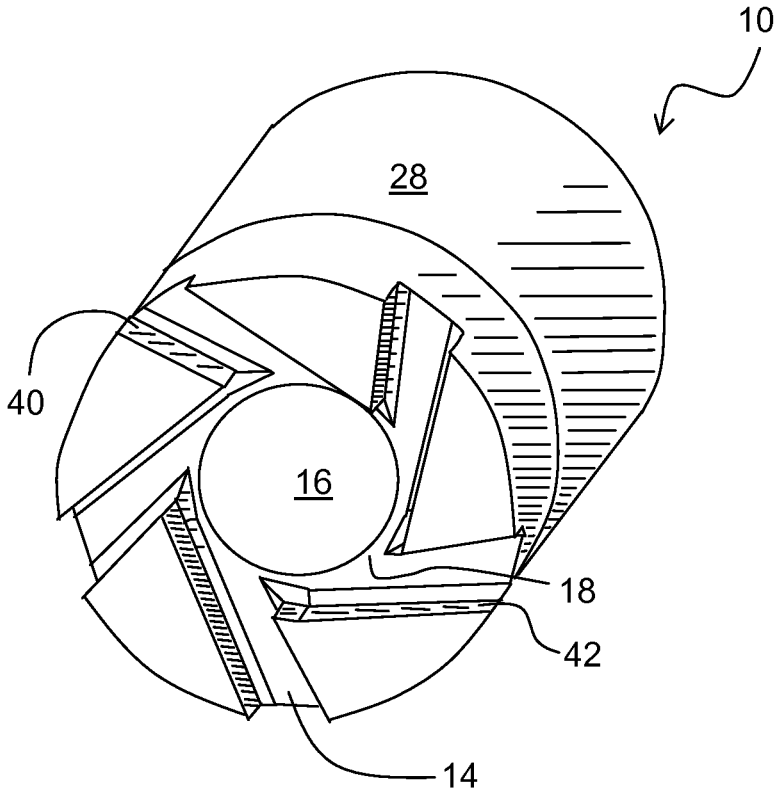
FIG. 6 shows a perspective view of an embodiment of a pour tube of the present invention sectioned along a plane passing horizontally through the port distributor.

FIG. 6 shows a perspective view of an embodiment of a pour tube 10 of the present invention sectioned along a plane passing horizontally through the port distributor. Bore 16 is in fluid communication with port distributor 18. Each of five exit ports 14 has an inner exit port wall 40 and an outer exit port wall 42 partially defining the exit port. Outer exit port walls 42 are tangent to a circle that is larger than the bore diameter above the ports; this configuration is referred to as an offset configuration.

Figure 7:
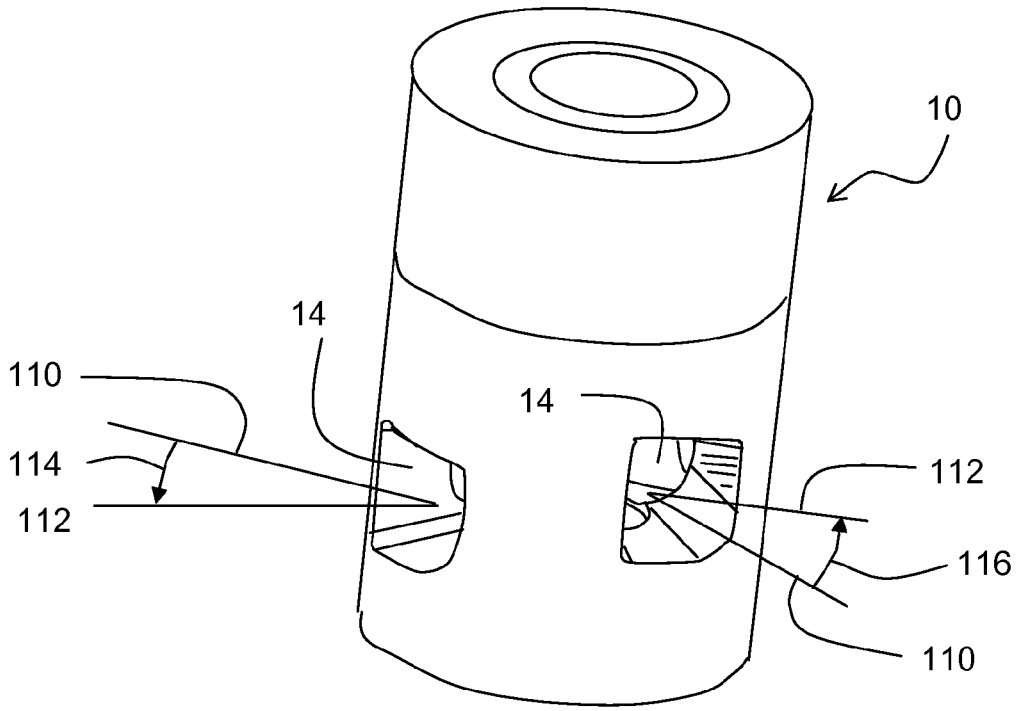
FIG. 7 shows a side perspective view of an embodiment of a pour tube of the present invention.

FIG. 7 shows a side perspective view of an embodiment of a pour tube 10 of the present invention. In this embodiment, exit ports 14 are configured so that exit port upstream surfaces and exit port downstream surfaces are not in the horizontal plane. The axis of each port is shifted from horizontal direction 110. The port axis 112 may be shifted by an angle 114 below the horizontal, or by an angle 116 above the horizontal. In certain embodiments, the pour tube has an even number of ports, and consecutive ports around the periphery of the pour tube have axes that are alternately shifted upwards and downwards. In other embodiments, the pour tube has an even number of ports, and consecutive ports around the periphery of the pour tube have axes that are alternately horizontal and shifted downwards. A particular embodiment of the invention may have four lateral ports, oriented at 90-degree intervals around the periphery of the pour tube. Each port in this embodiment has a flare of 2 degrees to improve jet diffusion from the port. Two ports have a downward angle of 15 degrees and the other two ports have an upward angle of 5 degrees.

Figure 8:
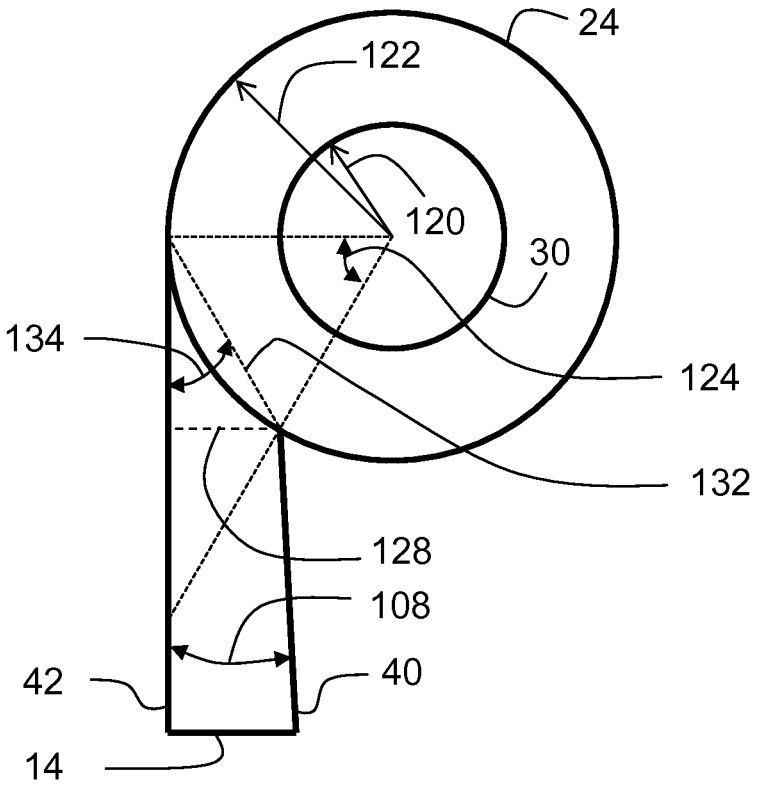
FIG. 8 shows a diagram of the terminology used to describe the geometry of the distributor port and exit ports of a pour tube of the present invention.

FIG. 8 is a diagram, in the horizontal plane, of various geometrical elements of an embodiment of a pour tube of the present invention. A circle represents the radial extent 24 of the port distributor. Another circle represents the radial extent 30 of the bore. Bore radius 120 represents the distance from the center of the bore to the radial extent 30 of the bore. Port distributor radius 122 represents the distance from the center of the port distributor to the radial extent 24 of the port distributor. Rotation angle 124, also designated by the symbol theta, represents the angle around the periphery of the port distributor that is occupied by an individual port. Port width 128, perpendicular to the axis of an exit port 14, at the point of contact of the port with the port distributor, is also designated by the letter a. The flare angle 108 of the opening port in the horizontal plane represents the angle between an inner port wall 40 and an outer port wall 42, and is also designated by the symbol gamma. Port entrance line 132 represents the distance between the inner port wall-port distributor intersection and outer port wall—port distributor intersection for a given port. Port exit angle 134 represents the angle between the port entrance line 132 and outer port wall 42.

Figure 9:
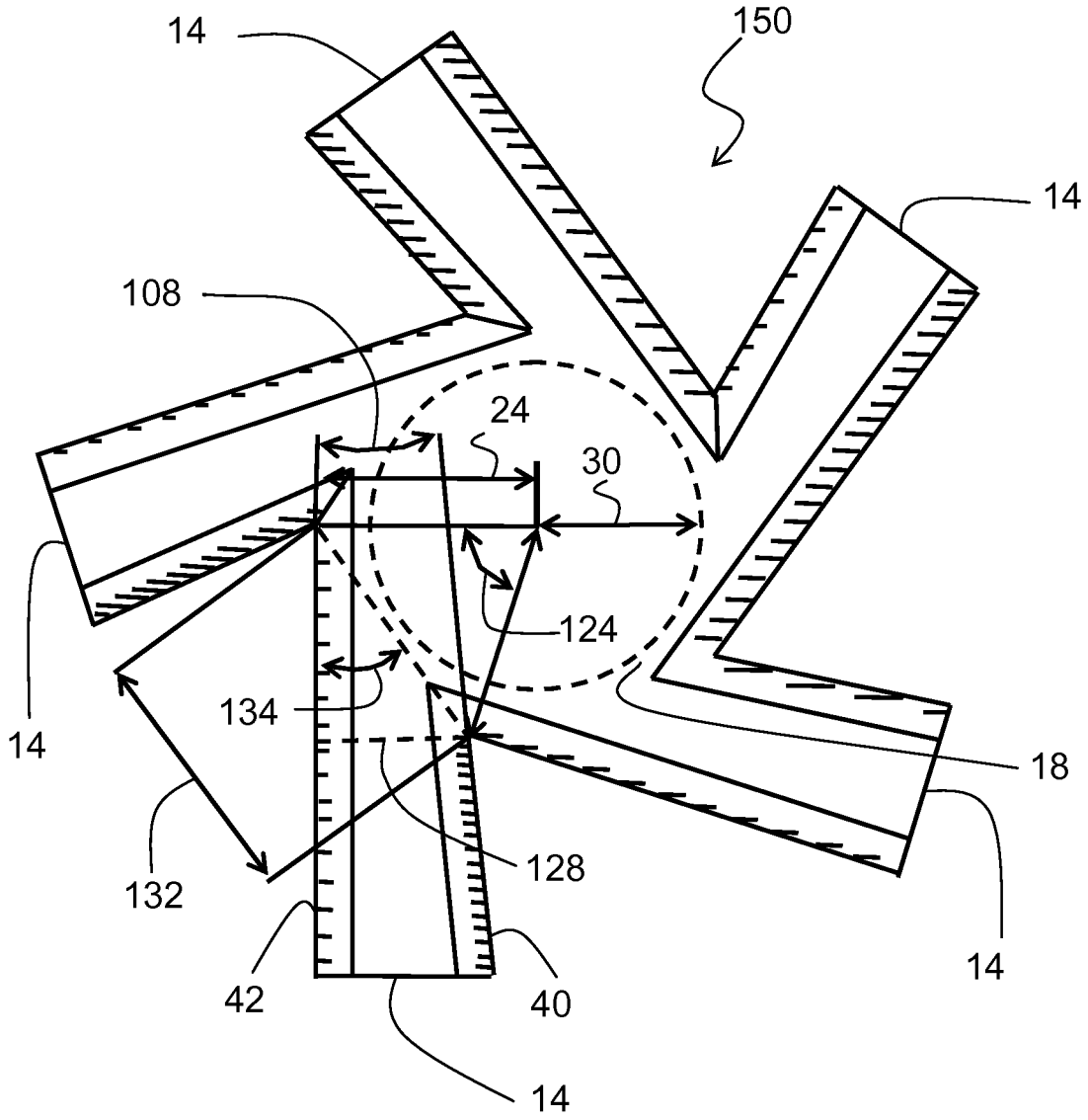
FIG. 9 shows a perspective view, from the bottom, of a distributor port of an embodiment of a pour tube of the present invention.

FIG. 9 is a bottom view of a flow assembly 150 of a port distributor 18 and five exit ports 14 contained in an embodiment of a flow tube of the present invention. The port distributor has a port distributor radial extent 24, which is greater than bore radial extent 30. The flare angle 108 of the opening port in the horizontal plane is designated by the symbol gamma. Rotation angle 124, designated by the symbol theta, represents the angle around the periphery of the port distributor that is occupied by an individual port. Port width 128, perpendicular to the axis of the port, at the point of contact of the port with the port distributor, is designated by the letter a. The flare angle 108 of the opening port in the horizontal plane is designated by the symbol gamma. Port entrance line 132 represents the distance between the inner port wall-port distributor intersection and outer port wall-port distributor intersection for a given port having an inner port wall 40 and an outer port wall 42. Port exit angle 134 represents the angle between the port entrance line 132 and outer port wall 42.

Figure 10:
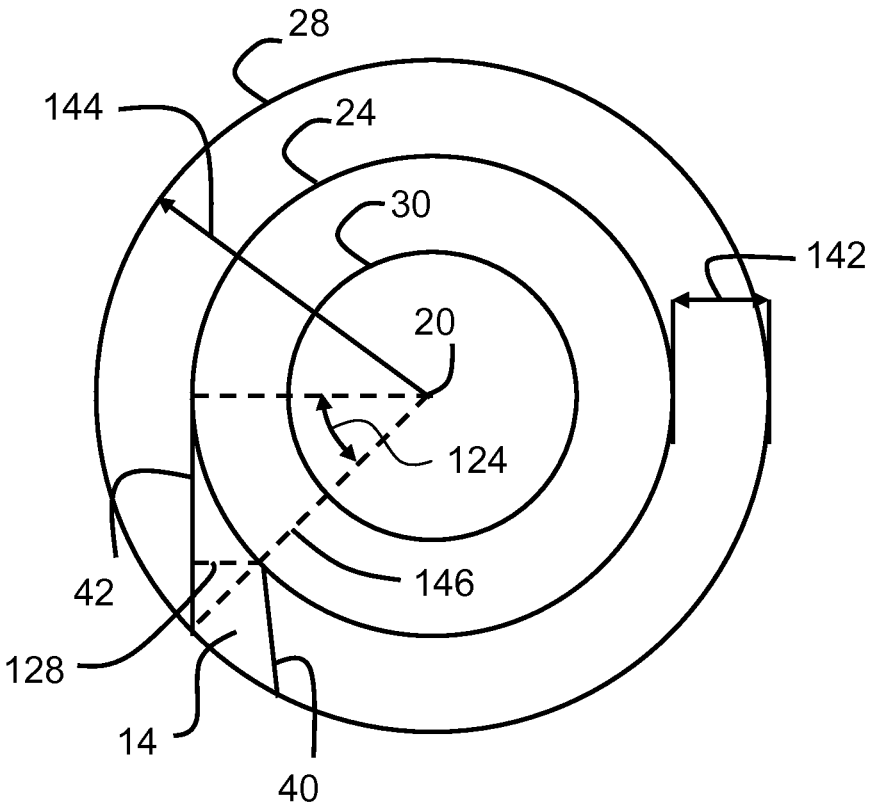
FIG. 10 shows a diagram of the terminology used to describe the geometry of the distributor port and exit ports of a pour tube of the present invention.

FIG. 10 is a diagram, in the horizontal plane, of various geometrical elements of an embodiment of a pour tube of the present invention. A circle represents the radial extent 24 of the port distributor. Another circle represents the radial extent 30 of the bore. A circle surrounding the radial extent of the bore and the radial extent of the port distributor represents the outer surface 28 of the pour tube. The vertical axis of the port distributor 20 intersects the horizontal plane of this representation. Exit port 14 is partly described by inner exit port wall 40 and outer exit port wall 42. Rotation angle 124, designated by the symbol theta, represents the angle around the periphery of the port distributor that is occupied by an individual port. The wall thickness 142 of the pouring tube around the port distributor is represented by the distance between the radial extent of the port distributor 24 and the outer surface 28 of the pour tube. Port distributor exterior radius 144 represents the distance between the vertical axis of the port distributor 20 and the exterior surface 28 of the pour tube in a horizontal plane of the port distributor. Exit line 146 represents a radial line, in the horizontal plane, from the vertical axis of the port distributor. For certain embodiments of the present invention, all exit lines emanating in a horizontal plane from the vertical axis 20 of the port distributor intersect an exit port wall before they reach the exterior surface 28 of the pour tube.

Figure 11:
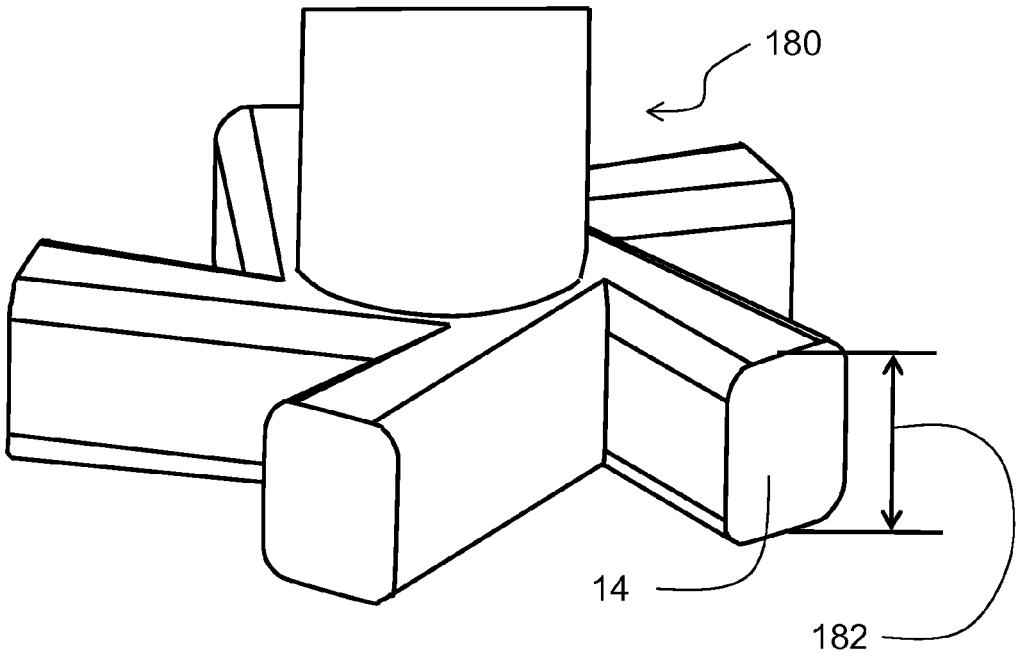
FIG. 11 shows a side perspective view of a distributor port of an embodiment of a pour tube of the present invention.

FIG. 11 is a side elevation perspective view of a flow assembly 180 of a port distributor and five exit ports contained in an embodiment of a flow tube of the present invention. A port height 182 is shown for an exit port 14.

Pour tubes of the present invention make use of one or more of a number of design elements:

1) There are at least two exit ports. Pour tubes according to the present invention may have three, four, five, six, or a greater number of exit ports.

2) The radial extent of the port distributor is greater than the radial extent of the bore.

$$r_{pd}>r_b$$

where $r_{pd}$ is the radial extent of the port distributor and $r_b$ is the radial extent of the bore.

3) The width of the port entrance for manufacturing or casting liquid metals is equal to, or greater than, 8 mm. The rotation angle around the periphery of the port distributor occupied by the port, expressed in radians, follows the mathematical relationship $$\text{theta}\geq 2\ \text{asin}(\sqrt{(8/(2r_{pd}))}),$$

where $r_{pd}$ is the port distributor radius expressed in millimeters and theta is the rotation angle around the periphery of the port distributor occupied by the port, expressed in radians.

4) The arc length from the inner port wall-port distributor intersection and outer port wall-port distributor intersection for a given port is equivalent to $r_{pd}$ multiplied by theta, and follows the relationship $$4\pi r_b>nr_{pd}(\text{theta})>1.3\pi r_b$$

where $r_b$ is the bore radius, n is the number of exit ports, $r_{pd}$ is the port distributor radius, and theta is the rotation angle around the periphery of the port distributor occupied by the port, expressed in radians.

5) The flare angle gamma between the inner port wall and the outer port wall of a port follows the relationship $$\pi/2>\text{gamma}>0$$

where gamma is expressed in radians.

6) The port height is expressed by the relationship $$3\pi r_b^2>hna>0.5\pi r_b^2,$$

where $r_b$ is the bore radius, h is the exit port height, n is the number of exit ports, and a is the width of the port entrance. In terms of absolute values, an embodiment of the invention makes use of exit ports having an exit port height equal to or greater than 8 mm to facilitate manufacturing of the pour tube of the invention, and to expedite liquid metal castability.

7) If there is to be no straight line, in the horizontal plane, passing from the vertical axis of the port distributor and through an exit port to the exterior of the pour tube, the angle theta around the periphery of the port distributor occupied by an exit port is expressed by the relationship $$\text{theta}<\arccos(r_{pd}/r_{ex})$$

or the pour tube is configured so that $$a<r_{pd}(r_{ex}-r_{pd})/r_{ex})$$

where a is the width of the port entrance, $r_{pd}$ is the port distributor radius and $r_{ex}$ is the pour tube radius in the horizontal plane of the port distributor. In terms of absolute values, an embodiment of the invention makes use of exit ports having an exit port width equal to or greater than 8 mm to facilitate manufacturing of the pour tube of the invention, and to expedite liquid metal castability.

In an example of an embodiment of the invention showing the relationships among geometrical factors, the pour tube has four ports (n=4). The bore radius $r_b$ is 20 mm, and the port distributor radius $r_{pd}$ is 25 mm. The minimum angle for theta is derived by the formula $$\text{theta}=2\ \text{asin}(\sqrt{(8/(2r_{pd})}=2\ \text{asin}(\sqrt{(8/(2\times 25)}=47.1\ \text{degrees}$$

For four ports, the range of suitable arc lengths from the inner port wall-port distributor intersection and outer port wall-port distributor intersection for a given port is derived by $$4\pi(20)>4(25)(\text{theta})>1.3\pi(20)$$

$$144\ \text{degrees}>(\text{theta})>46.8\ \text{degrees}$$

In another illustrative example of an embodiment of the invention, the pour tube has four ports (n=4). The bore radius $r_b$ is 20 mm, and the port distributor radius $r_{pd}$ is 40 mm. The minimum angle for theta is derived by the formula $$\text{theta}=2\ \text{asin}(\sqrt{(8/(2r_{pd})}=2\ \text{asin}(\sqrt{(8/(2\times 40)}=36.87\ \text{degrees}$$

For four ports, the range of suitable arc lengths from the inner port wall-port distributor intersection and outer port wall-port distributor intersection for a given port is derived by $$4\pi(20)>4(40)(\text{theta})>1.3\pi(20)$$

$$90\ \text{degrees}>(\text{theta})>26.7\ \text{degrees}$$

In particular embodiments of the invention, the radial extent of the port distributor and the radial extent of the bore differ by 2.5 mm, a value greater than 2,5 mm, 5 mm, or a value greater than 5 mm. In particular embodiments of the invention the radial extent of the port distributor is 25% greater, or at least 25% greater, than the radial extent of the bore.

The number of exit ports, the increased radial extent of the port distributor, the offset configuration of the outer wall of the exit port, the width of the port entrance, the arc length from the inner port wall-port distributor intersection and outer port wall-port distributor intersection for a given port, the flare angle of the port walls, the port height, and the absence of a straight line, in the horizontal plane, passing from the vertical axis of the port distributor and through an exit port to the exterior of the pour tube produce, singly or in combination, swirling of the fluid around an exit port axis as it flows outward through the exit port. The port geometry produces, with respect to prior art designs, a decrease in jet momentum of fluid passing through the exit ports. Consequently, if a pour tube of the present invention is placed in a mold, the strength of the jets coming in contact with the mold wall is decreased. This reduction in jet strength is observed in rectangular molds as well as in round molds. In addition, the pour tube of the present invention provides lower ratio of exit port velocity with respect to inlet velocity than do prior art pour tubes. In round and rectangular molds, a four-port pour tube of the present invention can produce a ratio of average port velocity over inlet velocity of 1.04, 1.03, 1.00 or less. In round and rectangular molds, a six-port pour tube of the present invention can produce a ratio of average port velocity over inlet velocity of 0.73 or less. Pour tubes of the present invention produce curved fluid paths both within and outside the exit port. Pour tubes of the present invention with four ports and six ports produce a swirling velocity that is uniform and evenly distributed.

Numerous modifications and variations of the present invention are possible. It is, therefore, to be understood that within the scope of the following claims, the invention may be practiced otherwise than as specifically described.

I claim:

1. A pour tube for use in casting a stream of molten metal from an upstream position to a downstream position, the pour tube having a pour tube central longitudinal axis and comprising an inner surface defining a bore and a port distributor in fluid communication, and an outer surface having at least two exit ports, wherein each port has a straight central longitudinal axis, wherein the exit ports are in fluid communication with the port distributor, wherein the port distributor is located downstream of the bore, and wherein the port distributor has a greater radius with respect to the pour tube longitudinal axis than does the bore, and wherein the exit port central longitudinal axes do not intersect the pour tube longitudinal axis, and wherein the exit ports comprise an inner wall and an outer wall, each in communication with the port distributor and the outer surface, wherein the outer wall has a greater length than the inner wall, and wherein the exit ports are spaced regularly at a rotation angle theta around the periphery of the port distributor, and wherein the exit ports have a port width of at least $$2r_{pd}\sin(\text{theta}/2)^2$$

wherein $r_{pd}$ is the port distributor radius and theta is the rotation angle around the periphery of the port distributor occupied by the port, expressed in radians.

2. The pour tube of claim 1, wherein the radius of the port distributor is less than twice the radius of the bore.

3. The pour tube of claim 1, wherein horizontal projections of the outer walls of the exit ports do not intersect the bore.

4. The pour tube of claim 1, wherein horizontal projections of the outer walls of the exit ports do not intersect a vertical projection of the bore.

5. The pour tube of claim 1, wherein the outer walls of the exit ports are tangent to a circle that is concentric with the bore and has a greater radius than the bore.

6. The pour tube of claim 1, wherein the outer walls of the exit ports are tangent to the port distributor.

7. The pour tube of claim 1, wherein the exit ports are configured so that $$4\pi r_b > n r_{pd}(\text{theta}) > 1.3\pi r_b$$

wherein $r_b$ is the bore radius, n is the number of exit ports, $r_{pd}$ is the port distributor radius, and theta is the rotation angle around the periphery of the port distributor occupied by the port, expressed in radians.

8. The pour tube of claim 1, wherein the exit ports have a nonzero flare angle, in a horizontal plane orthogonal to the longitudinal axis of the pour tube, that is equal to or less than theta/2, wherein theta is the rotation angle around the periphery of the port distributor occupied by the port, expressed in radians.

9. The pour tube of claim 1, wherein the exit ports are configured so that $$3\pi r_b^2 > hna > 0.5\pi r_b^2$$

wherein $r_b$ is the bore radius, h is the exit port height, n is the number of exit ports, and a is the width of the port entrance.

10. The pour tube of claim 1, wherein the outer surface has four ports.

11. The pour tube of claim 1, wherein the outer surface has six ports.

12. The pour tube of claim 1, wherein the outer surface has five ports.

13. The pour tube of claim 1, wherein at least one port around the periphery of the pour tube has a central longitudinal axis directed above a horizontal plane orthogonal to the longitudinal axis of the pour tube.

14. The pour tube of claim 1, wherein at least one port around the periphery of the pour tube has a central longitudinal axis directed below a horizontal plane orthogonal to the longitudinal axis of the pour tube.

15. The pour tube of claim 1, wherein at least one port around the periphery of the pour tube has a central longitudinal axis directed below a horizontal plane orthogonal to the longitudinal axis of the pour tube, and wherein at least one port around the periphery of the pour tube has a central longitudinal axis directed above a horizontal plane orthogonal to the longitudinal axis of the pour tube.

16. The pour tube of claim 1, wherein the port distributor has a greater radius with respect to the longitudinal axis than does the entire length of the bore.

17. The pour tube of claim 1, wherein each exit port inner wall is shielded from the longitudinal axis of the port distributor.

* * * * *